United States Patent [19]

Byrne

[11] Patent Number: 4,646,846

[45] Date of Patent: Mar. 3, 1987

[54] SPRINKLER HEAD HOUSING

[75] Inventor: Barry F. Byrne, Killarney Heights, Australia

[73] Assignee: Wormald International Ltd., Crows Nest, Australia

[21] Appl. No.: 652,827

[22] Filed: Sep. 20, 1984

[30] Foreign Application Priority Data

Sep. 27, 1983 [AU] Australia ..... PG1590

[51] Int. Cl.[4] ..... A62C 37/30

[52] U.S. Cl. ..... 169/42

[58] Field of Search ..... 169/42, 37, 51, 40, 169/60, 19; 411/500-503

[56] References Cited

U.S. PATENT DOCUMENTS

| | | | |
|---|---|---|---|
| 17,262 | 8/1903 | Jackson | 411/502 |
| 3,246,432 | 4/1966 | Young | 169/42 X |
| 3,714,989 | 2/1973 | Gloeckler | 169/42 X |
| 3,727,695 | 4/1973 | Danton | 169/42 X |
| 3,756,321 | 9/1973 | Glockler | 169/40 |
| 3,998,273 | 12/1976 | Juliano | 169/42 X |
| 4,014,388 | 3/1977 | Anderson | 169/42 X |
| 4,066,129 | 1/1978 | Anderson | 169/42 X |
| 4,105,076 | 8/1978 | Simon et al. | 169/42 X |
| 4,215,751 | 8/1980 | Mears | 169/42 X |

OTHER PUBLICATIONS

European Search Report for EP 84 11 1409.

*Primary Examiner*—Joseph F. Peters, Jr.
*Assistant Examiner*—Kevin Patrick Weldon
*Attorney, Agent, or Firm*—Ladas & Parry

[57] ABSTRACT

A concealing housing for a ceiling-mounted fire sprinkler head in which a bottom cap is automatically released to uncover the sprinkler head in the advent of a fire, the housing comprising a body supported by the sprinkler head, and a plurality of connecting studs to hold the cap to the body, each stud being of sheet metal and being releasably connected at a foot portion by low-temperature solder to the cap and threaded by a head portion through a hole in the body until an intermediate shoulder on the stud engages the body said stud being bent over at its head portion for retention upon the body.

11 Claims, 5 Drawing Figures

SPRINKLER HEAD HOUSING

This invention relates to housing for sprinkler heads of the kind used for discharging and disseminating fire-fighting fluids, such as chemicals and water.

Principally for aesthetic reasons it is becoming customary to conceal from view within a room the sprinkler heads provided for its protection against fire. The head assembly is recessed within say a ceiling and a cover attached which is jettisoned when or before the sprinkler head becomes operative. To ensure its release it is attached by low temperature solder to tabs pressed out of the body of a housing secured to the sprinkler head frame. However, it has been found that before release heat is transferred from the cap through the lugs to the body where dissipation occurs and correct timing of release of the cap is difficult to predict and arrange.

It is a principal object of the present invention to provide a form of housing for a sprinkler head which substantially avoids this defect.

To this end in accordance with the invention there is provided a housing for a fire sprinkler head of the kind including a frame attachable to a fluid line, and a valve and confronting fluid disseminator on the frame and separated by a heat-responsive element, said housing comprising a base for support by said frame, an open ended hollow body on said base to encircle said sprinkler head, a cover to conceal said sprinkler head, and a heat responsive releasable connection between said cover and said body, said connection being characterized by a plurality of spaced studs each having a foot portion at one end attached to a concealed part of said cover by heat-responsive releasable means, a narrowed portion near the other end extending from an intermediate shoulder and passed through a hole in said body and bent to lock said cap upon said body with said shoulder spacing said cap from said body.

The invention will be better understood with reference to the accompanying drawings in which.

Figure 5:
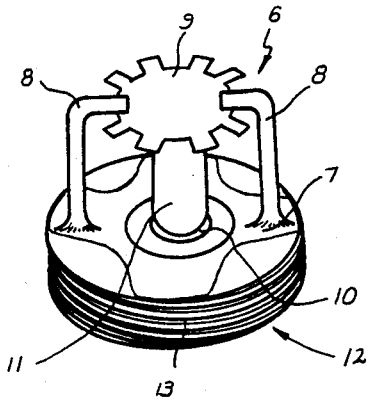
FIG. 5 shows in perspective a sprinkler head assembly and a housing of this invention therefor.
Figure 5:
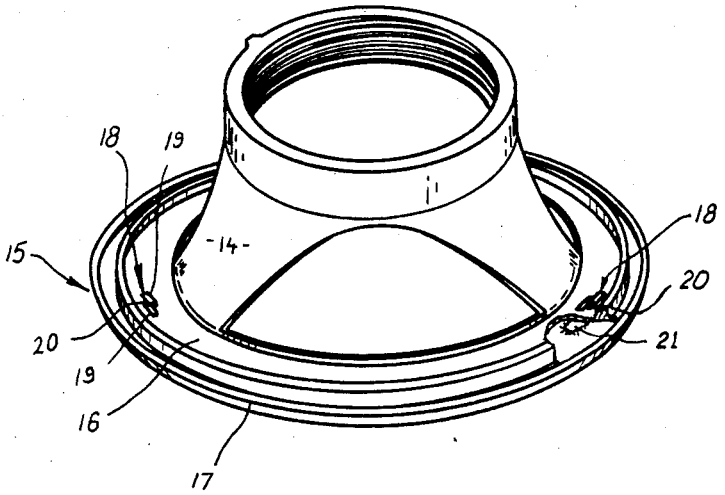

With reference firstly to FIG. 5, a sprinkler head 6, of conventional form for ceiling mounting, and comprising a frame 7 supporting on arms 8 a disseminator 9 confronts a fluid valve 10 which is held closed by a heat-responsive element shown as a frangeable bulb 11.

A housing constructed according to this invention consists of a cylindrical base 12 provided with an external thread 13, on to which may be screwed an open ended, hollow housing body 14 encircling said frame 7 which supports a cap 15 designed to conceal the sprinkler head 6. The base 12 is interlocked with the frame 7 in any convenient manner, but preferably is assembled over the frame 7 to be supported thereby. For convenience of illustration the base 12 and frame 7 are inverted from their operating position and will be reversed for insertion into the body 14. Preferably the base 12 and body 14 are composed of diecast metal while the cap is of brass or copper alloy sheeting and has its outer face painted or otherwise attractively finished. It will be noted that the body 14 and the cap 15 have parallel rim portions 16 and 17 and several studs 18, say three, by their lugs 19 are passed through holes 20 spaced around and formed in the rim portion 16 of the body 14. The studs 18 each have a foot portion 21 which is fastened by low-temperature solder to the rim portion 17 of the cap 15.

Figure 1:
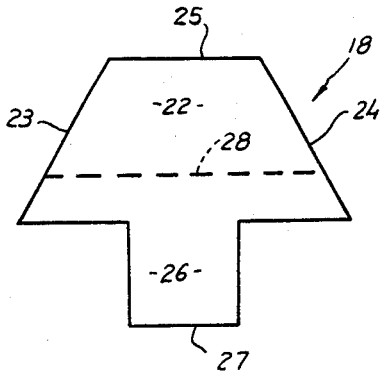
FIG. 1 shows in plan a blank of a fixing stud used for securing the cover to the body of a housing constructed according to this invention.
Figure 2:
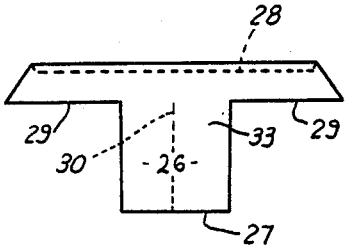
FIG. 2 shows the same stud after a folding operation.
Figure 3:
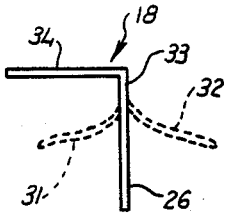
FIG. 3 is a side elevation of the stud of FIG. 2.
Figure 4:
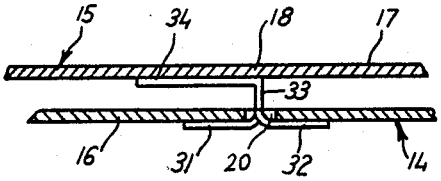
FIG. 4 shows the same stud in operation.

The studs 18 are especially constructed to ensure very little transfer of heat from the cap 15 to the body 14. To achieve this each stud 18 is formed from sheet metal such as brass, firstly as a blank 22 as shown in FIG. 1. The blank 22 has diverging sides 23 and 24 from its end 25 and a narrow stem 26 at its opposite end 27. The blank 22 is bent L-shape on the line 28 to appear as shown in FIG. 2. It will be seen that by the provision of the stem 26 centrally in one arm opposite intermediate shoulders 29 are created. The stem 26 is then split on line 30 so that two adjacent lugs 31 and 32 are formed which can be bent to opposite sides out of the plane of the arm 33 as shown in FIGS. 3 and 4. The other arm 34 of the stud 18 serves as the foot 21, shown in FIG. 5, which is soldered to the underside of the cap 15.

In operation it has been found that due to line contact as opposed to surface contact, which exists between the studs 18 and the body 14 through abutment of the shoulders 29 with the rim portion 16 of the body 14, and the resulting spacing between both rim portions 16 and 17, little transference of heat occurs from the cap 15 so that the solder joint between the feet 21 of the studs 18 and the underside of the cap 15 will respond in a predictable manner to its rising temperature in the event of a fire.

It should be understood that in addition to the preferred embodiment described above other forms and modifications are feasible within the scope of this invention.

What I claim is:

1. A housing for a fire sprinkler head of the kind including a frame attachable to a fluid line and a valve and confronting fluid disseminator on the frame and separated by a heat-responsive element, said housing comprising a base for support by said frame, an open-ended hollow body on said base to encircle said sprinkler head, a cap to conceal said sprinkler head, and a heat-responsive releasable connection between said cap and said body, said connection being characterized by a plurality of spaced studs each having a foot portion at one end attached to a concealed part of said cap by heat-responsive releasable means, a narrowed portion near the other end extending from an intermediate shoulder and passed through a hole in said body and bent to lock said cap upon said body with said shoulder spacing said cap from said body.

2. A housing according to claim 1, wherein each of said studs is composed of sheet metal folded L-shape of which one arm constitutes said foot portion, and the narrowed portion is split to form adjacent lugs which after insertion through said hole in said body are bent in opposite directions away from said hole.

3. A housing according to claim 2, wherein said narrowed portion is a centrally disposed stem in the other arm of the L-shaped stud whereby shoulders are formed at opposite sides of the narrowed portion.

4. A housing according to claim 1, wherein said heat-responsive releasable means attaching the foot portion to said cover is low-temperature solder.

5. A housing, according to claim 1, wherein said studs are in line contact with the body, but said studs are free of surface contact with said body.

6. A housing, according to claim 1, wherein said body is free of springs.

7. A housing, as in claim 1, which is free of heat insulating material.

8. A housing to conceal from below a ceiling-mounted fire sprinkler head, and comprising a base for support from said spinkler head, a hollow open-ended body attachable to said base to encircle said sprinkler head, and a cap automatically releasably connected to said body to close the lower open end thereof by a releasable connection comprising a plurality of discrete sheet metal studs each of which has a foot portion soldered to an upper surface of the cap and a narrow head portion enterable through a hole in said body to a degree limited by an intermediate shoulder on said stud and bent to hold said shoulder against said body.

9. A housing, as in claim 5, which is free of heat insulating material.

10. A housing, as in claim 6, which is free of heat insulating material.

11. A housing, as in claim 8, wherein said studs are in line contact with the body, but said studs are free of surface contact with the body.

* * * * *